US005830080A

United States Patent [19]

Reynolds

[11] Patent Number: 5,830,080

[45] Date of Patent: Nov. 3, 1998

[54] TURF SIMULATING SURFACE

[76] Inventor: Richard C. Reynolds, 2504 Nora's Ct., North Wales, Pa. 19454

[21] Appl. No.: 881,341

[22] Filed: Jun. 24, 1997

[51] Int. Cl.[6] ..... A63B 69/36

[52] U.S. Cl. ..... 473/278; 273/DIG. 8

[58] Field of Search ..... 473/278, 279; 273/DIG. 8

[56] References Cited

U.S. PATENT DOCUMENTS

| | | | |
|---|---|---|---|
| 2,573,107 | 10/1951 | Morgan | 473/278 |
| 3,880,432 | 4/1975 | Coffey et al. | 473/278 |
| 3,995,079 | 11/1976 | Haas | 473/278 X |
| 5,205,562 | 4/1993 | Hammon | 473/278 |

*Primary Examiner*—George J. Marlo
*Attorney, Agent, or Firm*—Elman & Associates

[57] ABSTRACT

A turf-simulating surface and golf practice tee device simulates the properties of natural turf. The device is made of two independent components the first of which simulates the first two layers of natural soil and is a composite mat comprising an integral pile section and plastic foam layer. The pile section has tufted strands that simulate grass, and a loop portion that is interactively positioned in a lateral-strength fabric. A plastic foam element is bonded to both the lateral-strength fabric and to the looped regions of the pile section. The second component is a rimmed base that simulates the supporting properties of the deeper layers of natural soil. The second component has a rim that is integrally formed around a foamed-plastic composite core, the density of which increases from the top to the bottom.

17 Claims, 8 Drawing Sheets

TURF SIMULATING SURFACE

FIELD OF THE INVENTION

This invention relates to an artificial turf product designed to simulate the basic properties of natural turf and a method for making it.

BACKGROUND OF THE INVENTION

Artificial turf athletic mats for use for golf practice, or on a golf driving range, desirably have a particular set of physical properties. First, it is desirable to utilize a grass-like surface to simulate a grass golf course natural turf and surface. Second, the underlying support for such a mat is very important because golfers swing long, relatively heavy clubs, with great force. Should the club head ground on an unyielding surface, the surface, the club, and the golfer, may be injured. Third, on practice ranges, the surfaces of golf mats are subject to great wear because of the high level of use and frequent abuse. Previously disclosed mats have been found to be less than entirely satisfactory because they do not effectively simulate natural conditions and they wear too rapidly when in use.

Golf tee shots require the golf club to be swung so that the head passes cleanly through the position of the ball without impacting the ground surface. Practice surfaces used at driving ranges for tee shots should, however, deform to allow passage of the club head should the golfer strike the ball inexpertly and the club head inadvertently make contact with the practice surface. The surface should remain substantially undamaged so that a golfer may put in the hours of practice needed to obtain the desired level of proficiency. Previously disclosed mats have not satisfactorily met this need.

Golf fairway shots require the golf club to be swung so that the head passes through the position of the ball and on into the ground surface so as to displace a portion of turf, a "divot." Practice surfaces for fairway shots should deform to allow passage of the club head, provide sufficient resistance to give the "feel" of taking a divot, and remain undamaged so that a golfer may put in the hours of practice needed to obtain the desired level of proficiency.

Natural turf practice areas are not readily available in urban areas, and many artificial turf devices have been developed over the years in an attempt to accurately simulate the feel of natural turf to the golfer. Previously disclosed artificial golf mats have portions that can move in response to the impact of a club head. Such mats use springs, rubber bands, or the like to provide a movable surface. Other golf mats have artificial turf surfaces made of belts that move along the path of travel of the club head. These devices have achieved some success, but in general have proved too complex, too unreliable, or too cumbersome or non-portable for regular golf use.

Other prior art discloses mats for golf that are a simple rubber mat, some embodiments having a pile surface and others having a textured rubber surface. Polyurethane has also been used to form a golf mat, usually by being adhered to the back of a tufted carpet material. Such arrangements have not been found acceptable because the polyurethane pad and the tufted layer easily de-laminate, and the entire mat often fails to withstand the blows from the club head and rips into pieces.

Still other disclosed golf practice mats comprise an artificial turf surface bonded to a base formed of foam rubber or other multilayered materials. These devices are less complex than those having movable portions, but again have not proven totally successful because they do not accurately simulate the feel of natural turf to the golfer and tend to de-laminate along their edges or internally as the layers of which they are composed become separated. Other mats that have been made sufficiently strongly to avoid delamination are rigid and provide an unnatural feel when used.

Golf mats conventionally used at driving ranges have a very short lifetime because of the damage done to the mat in the area of the tee. Golfers practicing their tee shots will often hit the mat with a club rather than cleanly hit the ball off of the tee. Previously disclosed mats cannot withstand the substantial forces received by the mat under these conditions and become locally worn beyond use.

Previously disclosed golf mats have tended to be vulnerable to weathering. Exposure to ultra-violet light, heat from the sun and water from rain affect the long term quality of any surface. The artificial materials previously disclosed have proved unable to resist the radiation and heating effects of the sun. Open-celled foams that have been previously disclosed have a tendency to absorb water when exposed to the elements. All foams suffer from hydrophilic degradation. Open-celled foams, however, absorb and hold moisture that promotes degradation.

Because the many previously disclosed golf mats are multilayer constructs, their novel aspects primarily involve the bond between an artificial grass surface and a supportive substrate.

SUMMARY OF THE INVENTION

It is desirable that the look, feel, texture, and resilience of the artificial surface should closely simulate the properties of natural turf. Accordingly, it is an object of the present invention to provide an artificial surface for golf mats and driving ranges that has properties that simulate the properties of naturally grassed golf courses and is capable of withstanding heavy wear.

Natural turf has a structure that can be described as four general layers. Each layer has properties that affect the performance of the overall playing surface. The layers differ by function and the type of material they have in them. The layers are described herein as the grass layer, the vegetative layer, the root-biomass layer and the root-soil layer. The grass layer consists largely of the grass blades on which the golf ball lies when in play. The primary variable characteristic of this layer is the length of the grass blades. On a golf course fairway, grass is generally maintained at a uniform level that varies depending upon the species of grass used on the course. For example, "Bent grass" courses are maintained at about ¼ inch and rye grass courses at about ½ inch. In the rough, the grass blade length may vary widely as discussed below.

The vegetative layer is the layer where the grass blades join into the main vegetative meristem ("stem") of the grass plant and is the region from which the plant grows. The vegetative layer is thin, firm, springy and supportive. The support is formed by the connections between the grass blades of the first layer, the stems of the second layer and the roots of the third layer. The vegetative layer is generally only ⅛-inch to ¼-inch high with stems about 3/32-inch in diameter depending on the grass species and the mown height of the grass. The overall height of the vegetative layer is directly proportional to the grass blade length, e.g., in two-inch-high rough the vegetative layer might be ½-inch high and composed of stems 3/16-inch thick. Such rough offers a substantial resistance to the passage of a club head. If grass grows past ¾-inch in height, it begins to form a thatch, a build-up of interwoven live and dead grass, which increases the depth and density of this layer to an extent unsuitable for golf. Thatch is one reason why rough is so difficult to play. Keeping the grass ½-inch or less in height prevents the development of thatch and maintains direct access to the root-soil layer.

The structural integrity of the vegetative layer of the fairway offers little resistance to the passage of the club head because of the lack of thatch. The club head has sufficient mass and speed, and also has a sharp leading edge that enables it to cut through the turf. The integrity of the vegetative layer provides a vertical support matrix that holds a divot together and maintains the structure of the turf surrounding the divot until it is replaced. Without this structure a divot would fragment into its individual components. Dynamically, the divot flies just after and along the same relative path as the ball until air resistance slows it down.

The root-biomass layer of natural turf is extremely complex and is composed of the grass roots, living and dead organic material, mineral particles, air, water, and a variety of living organisms. The activities of the living organisms of the root-biomass layer (the biomass) constantly work to break down minerals and other materials to particles of critical size. The action of living organisms has a significant effect on the health of soil and plant life, and also has important effects on the performance characteristics of the turf.

On a golf course the root-biomass layer is usually about 50-percent space and 50-percent solid material. Grass roots help living organisms break up the soil and allow air and water to penetrate into the ground. Roots also establish vertical and horizontal integrity. They grow down to access water and out to increase their surface area for absorbing nutrients. The natural growth of roots gives turf its ability to repair itself. The 50-percent of space is about half filled with water which forms a thin film over almost all particles and materials in the layer. Through the playing season decaying material builds up, and constant activity compacts the turf. Golf courses aerate the turf twice a year to remove a percentage of the solid material so as to alleviate compaction and maintain the 50/50 ratio. Below the first two inches, the amount of space decreases with increasing depth.

The grass roots provide a structural integrity that holds the turf together in the face of natural forces and that holds a divot together when it is displaced by stroke of a golf club. In a divot struck from natural grass, the soil stays trapped in the roots of a divot so that turf rapidly regrows when the divot is replaced. However, the degree to which the other materials are present affects how a club head will cut through the soil. The root-biomass layer is usually an inch or so thick, depending on the grass species and the soil type. The horizontal growth of roots forms a matrix throughout the biomass layer that keeps the soil consistently loose and elastic. Most horizontal root growth occurs in the top inch-and-a-half and takes advantage of the nutrients present in the biomass layer. Roots penetrate significantly into the fourth layer. In summer, healthy grass roots grow 8 to 14 or more inches into the soil, depending on the species, the health of the soil, and the availability of water. Roots help link the third and fourth layers of the soil together and increase the flexibility of the root-soil layer. The third and fourth layers are also linked together by the physical interactions of the inorganic materials. Any artificial product should recognize and duplicate the particular attributes this function gives to natural turf.

The fourth, or root-soil layer, consists of the soil below the horizontal roots of the root-biomass layer. Other than the roots, this layer is compositionally similar to the third layer. However, incidence of living organisms declines with depth and the density of the soil increases with depth due to increased packing of the soil. The root-soil layer provides a firm base that supports the flexibility of the top three layers. The root-soil layer extends indefinitely below the surface, but meaningful texture and air infiltration is found only in the upper 2 inches of the root-soil layer.

The grass on golf courses is deliberately cut to different lengths on different regions of the course. On fairways, the grass is usually cut to ½-inch or less in height. This short grass makes playing conditions uniform and, permits more consistent play because the variability of the surface is diminished. The grass on greens and tees is usually cut to ¼-inch or less in height. The player has a great deal more control over the ball when the ball is so close to the ground. However, while the effect of the grass is diminished, the soil still has a significant role in affecting play. To simulate a natural turf, the performance relationship between the grass and the soil should be effectively emulated.

The "rough" of a golf course is of various lengths, generally no shorter than one inch and up to lengths of three to four inches. A ball that is sitting down in deep rough, i.e. rough that is higher than two inches, is very difficult to hit. Deep-rough grass is long and thick. It wraps around the club head and impedes its path to the ball. The ball will likely fly only a short distance compared to the distance the ball would fly if struck from the fairway. When the ball lies in short rough, several ball flights are possible, and the golfer has little control over the distance in this situation as well. For example, if the grass acts as a tee, the ball sits up and a player could hit the ball much further than intended. Practice tee areas are cut to fairway height to make practice more consistent for the player.

In areas such as deep rough or a bunker, the golf club cannot cut through very well because there is just too much resistance. However, bunkers are made of sand, a type of soil preparation which is uniform and consistent in its reactive qualities. Skilled players can use their skill to hit accurate, consistent shots from bunkers.

Golf players deliver force to the surface in two ways. As the player makes a stroke, turf is impacted in two places. First, as the club head strikes down and through the turf surface and strikes the ball and natural turf, the force of the impact radiates out and down about two to three inches. Second, the cleats of the shoes of the player create a shearing force on the turf as they push and twist through the stroke. The action of the golfer's feet can cause substantial wear because at a practice area, the player stands and hits from one position.

In golf, force is delivered to the playing, or "striking," surface by the impact of the club head. Accordingly, an object of the present invention is to provide acceptable levels of force feedback, when shock and vibration are rebounded at levels that are not uncomfortable and provide a natural-like experience to the golfer. Simulation of the supporting properties of the root-biomass layer and the force-absorbing and force-reflecting properties of the root-soil layer are an important aspect of the foam portion of the first and second component of the present invention.

Golf balls and golf clubs are designed to propel balls with backspin in order to affect and control the distance and direction of the flight of the ball. The club is designed to trap the ball between the face of the club and the ground so that the club face can exert a greater spin force on the ball. Forces are applied to a golf practice surface by the ball as it is trapped between the club head and the surface and by the club head directly. Forces are applied by the head as it swings through the line of travel, such forces may be delivered at speeds from a few miles per hour up to 150 mile per hour with compression loads from almost zero up to 2,000 pounds per square inch. Force is also delivered as the club head rotates about the axis of the club shaft. Shear forces may occur at up to 30° from the direction of application of the direct force due to the rotation of the club shaft and the curvature of the club head path. The properties of the surface therefore have a great effect on results achieved with the club.

A further object of the present invention is to provide a practice surface that simulates ground properties in a way that introduces a dynamic interaction at the same level that natural turf does. The invention disclosed herein effectively simulates the response of natural turf. Natural turf responds to such forces as swing velocity, impact load, and energy absorption (as determined by deceleration of the club head) and provides a corresponding rebound. The effects of these forces are simulated by the present invention.

The durability of artificial turf depends on the compression set of the supportive structures and the resistance of the overall mat to degradation and abrasion. Compression set is determined by the cell memory of the material, i.e. the way individual cells are deformed and recover from deformation. Compression set and compression deflection are important properties of the materials used in the present invention. Compression set is a measure of the ability of a material to handle the long-term effects of passive and active loading. Compression deflection is a measure of the ability of a material to handle immediate forces placed upon it, and also the consistency with which a material handles each individual event. Thus, a further object of the invention is to provide a surface that will deform and recover from deformation in a manner similar to natural turf. Urethane foams used in preferred embodiments of the present invention have superior consistency and provide these properties particularly well.

The present invention relates generally to a turf-simulating composite that provides a surface for golf or other use and that accurately simulates the four-layered structure of natural turf, e.g. to a golfer practicing golf shots thereon. A preferred embodiment of the turf-simulating composite of the present invention simulates the four-layer properties of natural turf. The turf-simulating comprises an integrally formed structure with a pile upper surface, a lateral-strength fabric and a supporting plastic-foam element. The plastic-foam supporting element may be of uniform density or be made with two or more sections with different densities. The pile upper surface of the turf-simulating composite has a loop portion at its base. The loop portion interacts with the lateral-strength fabric and the plastic foam elements encapsulate and physically bond to the lateral-strength fabric and to the loop portion. In a preferred embodiment of the invention the supporting plastic-foam element is one inch in depth. In another embodiment of the invention the supporting plastic-foam element is one inch in depth and the resiliency of it increases with depth.

A method of making a turf-simulating composite is also part of the invention. A preferred embodiment of the device is made by first making a lateral-strength fabric with a pile surface formed thereon. The pile section is formed by passing a loop portion of each pile strand around the strands of the lateral-strength fabric so as to interactively associate the pile strands and the lateral-strength fabric and leave a filament portion upstanding from the fabric. A plastic-foam element is then formed so that the plastic foam encapsulates and physically bonds to the lateral-strength fabric and to the loop portion of the pile surface. In one embodiment the plastic foam is of a graduated resiliency so that the foam immediately adjacent to the lateral-strength fabric is made of a plastic of about 8 to 12 pounds per cubic foot and has about 50% trapped air and the plastic foam most distant from the lateral-strength fabric is a plastic with a density about 8 to 12 pounds per cubic foot and about 10 to 20% trapped air.

Another embodiment of the invention disclosed herein that simulates the four-layer properties of natural turf is a golf practice surface made of two independent components. In this embodiment the first component is a mat that comprises an integrally formed composite of pile, fabric and plastic foam, that simulates the grass and root-biomass layers of natural soil. The second component of this embodiment is a rimmed base with a foamed-plastic composite core that simulates the root-soil layers of natural turf. The second component provides a strong and consistent support for the mat and provides additional shock absorbing features to absorb and dissipate the impact shock from the club head. The base is made of material that is strong and resilient enough to resist the continual movements when in use and to maintain a level and uniform striking surface. The base mimics the relevant performance characteristics of the fourth layer of natural soil. Embodiments of the base may have drain holes passing through to the soil to allow for the escape of water. The present invention that has no moving portions, has a simulated grass surface, has sufficient durability to be practicable and that may be placed in the ground so that the surface is level with the natural turf.

The pile of the composite mat has tufted strands that simulate grass and form a "hitting," or "striking," surface. The pile of the composite mat also has loop portions that interact with the lateral strands of the lateral-strength fabric. The plastic foam both encapsulates and physically and chemically bonds to both the lateral-strength fabric and to the looped portions of the pile section to form an integral structure that simulates how the vegetative layer and soil-biomass layer are bonded in natural soil.

A preferred embodiment of the present invention provides a golf practice tee that has a pile made of texturized nylon yarn with pile length of about ½-inch. In other embodiments of the invention the pile of the turf-simulating composite is made of texturized or untexturized nylon, polypropylene or polyolefin alloy, with or without an extruded coating. The properties of fibers that may be used in different embodiments of the inventions are shown in Table 1. Properties of fibers shown are for illustrative purposes, those of skill in the art will realize that other fibers with other properties may be used within the spirit of the invention.

TABLE 1

Properties of Fibers

| | Polyester | Nylon | Aromatic polyamides | Polypropylene |
|---|---|---|---|---|
| Size/dtex | 1500 | 1500 | 1500 | 1500 |
| Density | 1.39 | 1.14 | 1.44 | 0.95 |
| Tenacity | 9.92 | 10.0 | 20.3 | 6.0 |
| Initial modulus | 146 | 52 | 530 | 40 |

TABLE 1-continued

| Properties of Fibers | Polyester | Nylon | Aromatic polyamides | Polypropylene |
|---|---|---|---|---|
| Elongation at break (%) | 12 | 19 | 2.2 | 25 |
| Moisture regain % (at 25° C.; 55% RH) | 3–4 | 5–7 | 10–12 | 5–7 |
| Flex fatigue (% retained) | 95+ | 95+ | 75 | 80 |
| Decomposition temp. °C. | 290 | 215 | 382 | 150 |

Other embodiments of the golf practice tee device of the present invention have a pile that is made of strands of texturized nylon yarn or a polyolefin alloy with extruded coating. The loop portions of the pile are tufted, woven, or knitted into a lateral-strength fabric made of polypropylene, aramid, high-strength polyethylene or nylon. Other fabrics that create a springy horizontal matrix may also be used.

Still another embodiment of the invention has a double-ply fabric in which the first ply is a polypropylene type cloth, and the second fabric ply is a spun bonded pick-weave polypropylene fabric. Fabrics suitable for use in the present invention have from 13 to 24 strands per inch. That is the "grid" of the fabric will be from 13×13 to 24×24 strands per square inch. Preferably it is envisaged that the fabric will be from 15×15 to 21×21 strands per square inch. Most preferably fabrics with 18×18 strands per square inch have been found to most suitable.

Other embodiments of the invention have a one-sixteenth-inch to one-quarter-inch thick pile loop-portion that interacts with the lateral-strength fabric.

The foam elements of the invention are formed to have densities and resilient properties that differ depending on the particular use to which the embodiment is to be put. Generally, polyurethane foams may be used for the foam elements of the turf simulating composite of the invention. Polyurethane foamed elements of the present invention are integrally-skinned foams made by preparing a polymerization mixture by mixing an isocyanate source known conventionally in the trade as "Component A" with a polyol source that contains a blowing agent and a catalyst, "Component B." An extensive description of processes for forming polyurethanes and compositions of Components A and B, is found in U.S. Pat. No. 5,451,612, the disclosure of which is incorporated herein by reference. Generally however, the blowing agent of Component B includes a carbonate source, water and an acid source that upon reaction with Component A generates a gas, carbon dioxide, that foams the polymerizing urethanes to form a foamed plastic. Polyurethane foamed elements of the present invention are made by mixing Component A and Component B placing the mixture in a mold to form an integrally-skinned polyurethane element as disclosed in U.S. Pat. No. 5,451,612.

Polyurethane foamed elements of the present invention are made of different densities and resiliencies by mixing Component A and Component B in different ratios. Ratios of Component A to Component B that are found to yield foams particularly suited to the purposes of the present invention range from 45:100, to 51:100. Other ratios are, however, envisaged to be used to make embodiments of the invention to simulate particular conditions. The properties of flexible, integrally-skinned, microcellular polyurethanes are shown in Table 2.

In preferred embodiments of the invention the plastic foam element of the turf-simulating composite is a high-performance foam material with an average cell size of about 0.08-mm and a thickness of about one inch.

The base of a preferred embodiment of the invention is an integrally rimmed base that has a plastic-foam core about 2 inches thick with a density of about nine pounds per cubic foot. Generally, polyethylene foams are used for the foam elements of the base component of the invention.

TABLE 2

| Properties of Polyurethanes | Molded | Flexible molded | Elastomer |
|---|---|---|---|
| Skin Density (lb/cu. ft.) | | 25–65 | |
| Core Density (lb/Cu. ft.) | 1–40 | 5–20 | 21–65 |
| Tensile Strength (psi) | 10–1350 | 20–100 | 10–2500 |
| Compression strength (10% deflection) | 0.25–2500 | — | 10–100 |
| Compression strength (25% deflection) | — | 1–5 | — |
| Compression strength (50% deflection) | — | — | 100–2500 |
| Maximum temperature °F. | 250 | 175 | 250 |

The integrally formed rim of the base has a generally trapezoidal cross-section with a vertical internal surface that, together with the upper surface of the composite core, forms a recess that the turf-simulating composite fits into. The trapezoidal rim provides an angled external surface that tapers outwards so that the natural soil around the device can be laid over the angled external surface to securely hold the device down when it is used. Generally the base may be angled from 30° to 50° from the vertical, preferably at 40° from the vertical, however other angles suitable for use in the present invention will be known to those of skill in the art.

In preferred embodiments of the present invention, the rimmed base of the second component has a rim that is a generally trapezoidal shape and is integrally formed with the foamed-plastic core. The rim is shaped with a vertical internal face to form a recess. The composite mat that simulates the grass, vegetative and soil-biomass layers of turf fits into the recess in the rimmed base. The outside, or external surface, of the rim of the device is angled outwards towards the base so that a layer of natural soil can be overlaid on the angled surface to securely hold the base down when the golf practice tee device is in use. In preferred embodiments of the invention the external surface of the base is angled at 60°. In embodiments of the invention suitable for use on course tees, the rim of the device is formed separately from the foamed-plastic core.

In yet other embodiments of the invention a reinforcing rod is incorporated into the rim of the device. In such embodiments of the invention a polyethylene foamed-plastic core is first prepared and a groove is cut into the edge thereof leaving rough surfaces on the internal faces of the groove. A reinforcing rod of standard steel re-bar is then placed in the groove and the rim is then cast around the polyethylene foamed-plastic core. As the foam is cast it flows to completely surround and encapsulate the reinforcing rod and, as the foam cures, it expands to interdigitate with the rough surface of the precut groove and form an integral structure.

Further, the present invention relates to an artificial turf that accurately simulates the basic structures, properties, and dynamics of the grass, vegetative and third layers of natural turf. Embodiments of the invention disclosed herein relate to a novel golf practice surface, however, application of the present invention to other sports uses is envisaged.

Any of the embodiments of the invention described herein may additionally comprise a rim cast around the plastic foam elements of the composite core so that the rim becomes integrally associated with the plastic composite core. In certain embodiments of the invention the edges of the plastic composite core are shaped so that the rim and the core interlock when the rim is formed around the core.

Certain embodiments of the invention also have replaceable tee-blocks that can be set into the surface of the golf practice tee device to be flush with the surface. Tee-blocks, when used, are a composite with a pile portion, a lateral-strength fabric and a plastic foam element about two inches thick. Structurally, the tee-blocks are similar to the turf-simulating composite but differ in that they have a two-inch foam element in order that the full length of a standard tee may be inserted.

DETAILED DESCRIPTION OF THE INVENTION

Figure 1:
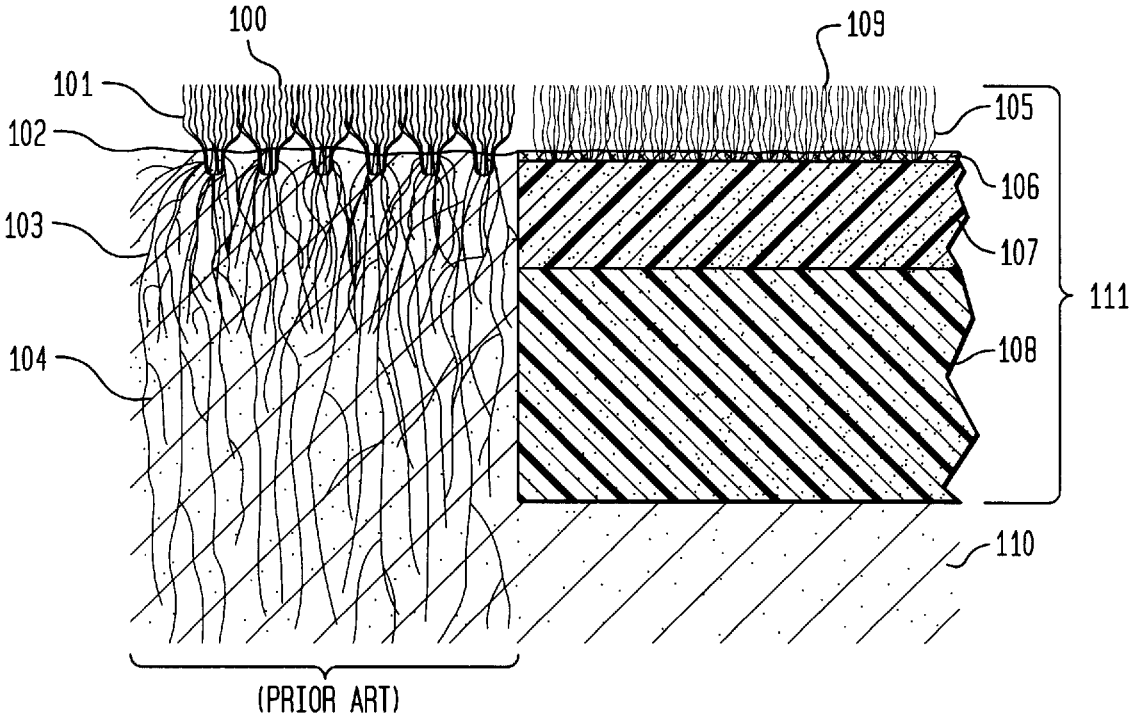
FIG. 1 represents cross-section view illustrating the layers of natural soil and the elements of the present invention.

The artificial turf invention disclosed herein simulates the performance qualities of natural turf. Particularly, the four-layered structure of golf course turf is simulated by the integral composite of the present invention that comprises an integrally formed pile upper surface, a lateral-strength fabric and one or more plastic foam elements. FIG. 1 shows a diagram that compares the four layers of natural turf, namely the grass layer 101, the vegetative layer 102, the root-biomass layer 103, and the root-soil layer 104, compared with the four elements of the composite mat 111 of the present invention, namely the pile element 105, the lateral-strength fabric 106, the foamed-plastic element 107 of the composite mat 111, and the supporting foam element 108 with the underlying natural soil 110. On natural turf, the golf ball is struck or hit from the grass surface 100, whereas when playing from the surface of this invention the ball is hit from the pile surface 109. The primary variable characteristic of the first layer is the length of grass blades which is generally maintained in the range of ¼-inch to ½-inch on a golf course fairway. The simulated grass, or pile, of the present invention preferably consists of a texturized nylon yarn that has a fiber height length of about ½-inch.

Definitions

Density—The denseness of a material expressed as mass per unit volume, either as pounds-per-cubic-inch, or as grams per cubic centimeter.

Elongation at Break ("E")—Also called "break elongation" is the change in length of a specimen compared to its no-load length at the moment of failure under load. E is usually expressed as percent (%).

Filament—The smallest component of a yarn.

Modulus ("M")—The property describing the resistance of a material to extension. Young's modulus or the "modulus of elasticity" represents the stress required to produce a given stretch or change in length. Modulus is area-specific, that is, it is expressed based on a unit of the original (i.e. no load) cross section. Modulus units are the same as those for "tenacity."

Tenacity/tensile strength ("T")—The ultimate strength exhibited by a material at the moment of failure based on a unit of the original (i.e. no-load) cross section. The most commonly used units are "pounds-per-square-inch" (psi); "grams per denier"(gpd); "Newtons-per-tex" (N/tex), and "pascals" (Pa). Frequently, the term "tensile strength" is used synonymously with "ultimate stress."

Yarn—Bundle or assembly of individual filaments.

The pile surfaces of the present invention are made from fiber forming polymers, one being a lateral-strength fabric of multi-filament wound yarn, the other being an extruded monofilament pile that is processed and knitted, woven or tufted into the fabric. The pile surface and the lateral-strength fabric of the composite mat in the present invention simulated the properties of the grass layer and springiness of the stem layer of natural turf. The supporting properties of the root-biomass layer and the force-absorbing and force-reflecting properties of the root-soil layer are simulated in the present invention by the foam elements of the turf-simulating composite mat and the foam elements of the second component, which is a foamed-plastic composite core formed within an integrally rimmed base.

Nylon is preferably used for the pile of the present invention because it has a high decomposition temperature. Most preferably, textured nylon is used. Textured nylon is used for two reasons: First, fibers made of textured nylon have a significantly increased crush resistance, and, second, the texturization also helps to counter the burnishing effect of the club head and yields a better product with a longer and more consistent working life. Polypropylene fiber that has been disclosed in the prior art, has been found to have a melting temperature too low for application in the present invention. A low melting temperature has two effects. First, the friction created by the golf club as it hits the surface of the fiber raises the temperature and can cause decomposition of the fiber. Polypropylene fibers have been found to be partially melted and decomposed by the heat induced by the friction of the golf club head. Second, the action of the golf club on a low-melting fiber actually burnishes it, and softens the fiber over time. The decomposition temperature of nylon is twice that of polypropylene. Other fiber-forming polymers that may be used in the present invention are polyesters, polyamides (e.g. nylon), aramides (e.g. Kevlar, Nomex), polyimides, acrylics and modacrylics, cellulosic polymers, olefinic and vinyl polymers. The properties of fibers that may be used in the present invention are shown in table 3.

High performance fibers suitable for use in the invention are aromatic polyamides, aromatic polyesters, aromatic polyimides and aromatic heterocyclic polymers. Aromatic high strength fibers are characterized not only by having a high tensile strength, but also by a high tensile modulus. In general, high-strength fibers have a high tensile modulus and exhibit relatively low elongation at break. However, not all fibers with a high tensile modulus have high fiber strength. Any fiber which may be deflected by the club and the ball without stretching and breaking may be satisfactorily used in the present invention.

The properties of the lateral-strength fabric used in the present invention, whether woven or non-woven, depend on the fabric structure and the properties of the constituent yarns and fibers. In natural turf the vegetative layer is the layer that provides a thin, firm, and springy support to the surface. A preferred embodiment of the present invention has a lateral-strength fabric as a backing substrate that effectively simulates the firm and springy characteristics of the vegetative layer. The plastic foam elements of the present invention also have a significant role in simulating the feel of a natural surface. Together, the lateral-strength fabric and the plastic foam elements yield an artificial mat with realistic feel.

An artificial pile layer that is knitted or tufted into a sheet-polypropylene backing is too weak, too deformable and lacks the modulus strength necessary to give an artificial grass with a realistic springy feel. Cloth lateral-strength fabrics are used in the present invention to achieve sufficient strength and to achieve a natural feel.

TABLE 3

| | Density (g/cc) | T (gpd) | E (%) | M (gpd) | Wet T (%) |
|---|---|---|---|---|---|
| Fibers - Conventional strength | | | | | |
| Nylon 66 | 1.28–1.34 | 6–10 | 20 | 30–50 | 50 |
| Nylon 6 | 1.14 | 5–10 | 15–40 | 15–55 | 60 |
| Polyester | 1.38 | 5–10 | 10–16 | 100–150 | 95 |
| Acrylic | 1.14–1.18 | 2.5–4.5 | 27–48 | 25–60 | 80–100 |
| Polyolefin | 0.95–0.96 | 5–8 | 10–20 | 25–50 | 100 |
| Polypropylene (commercial) | 0.95–0.96 | 4–9 | 15–35 | 25–100 | 100 |
| High performance fibers - Ultra High Modulus | | | | | |
| Polyolefin | — | 11.8 | 22–32 | 250 | 100 |
| Polypropylene | — | 35 | 22–32 | 1100 | 100 |
| High performance fibers - Aromatic polyamide fibers | | | | | |
| Kevlar 29 | 1.44 | 22 | 4 | 475 | — |
| Kevlar 49 | 1.44 | 22 | 2.5 | 976 | — |
| High performance fibers - Aromatic polyesters | | | | | |
| Ekonol | 1.40 | 27.5–31.0 | 2.4–2.9 | 1100 | — |
| Vectrum | 1.40 | 23 | 3.7 | 530 | — |

The backing fabric significantly affects the overall feel of the final surface. To achieve a realistic feel of the artificial device it is critical that the backing material effectively simulates the vegetative layer of grass in exactly the same vertically layered position as occurs in natural turf. This layer has a firm and springy feel, yet is thin enough to allow the club head to easily interact with the layer directly below.

Polyester fibers have been found to give a flexible yet strong, energy-absorbent mat when used as the lateral-strength fabric. These polyester fiber mats absorb and transfer the impact of the club and have a springy but firm feel when a club strikes the surface. Different types of fabrics or combinations of fabrics give a different feel and are used in different embodiments of the invention.

The artificial turf of the invention may be made from several manufactured polymers. The substrates are flexible, semirigid or rigid foams. The durability of plastic foams is significantly related to the chemical bonds present in the foam. For example, foams may be formed with materials having ether- or ester-based linkages. Ether-based foams are substantially more resistant to hydrophilic degradation that ester-based foams. Examples of materials that may be used to form the foam elements of the present invention are in shown in table 4. Preferably, it has been found that foam elements of the present invention have superior durability when they are formed from closed-celled, polyurethane-based or polyethylene-based foams. The foam elements of the present invention are integrally formed with the pile and the lateral-strength fabric, and the invention does not suffer from the de-lamination and degradation problems that affect prior art mats.

All the polymers of this invention are formed by the creation of chemical linkages between relatively small molecules, or monomers, to form very large molecules, or polymers. Thermosetting plastics have chemically cross-linked structures that are formed under the influence of heat, such plastics cannot thereafter be remolded. Other plastics that are chemically set may also not be moldable when warmed. Thermoplastic materials are chemically cross-linked structures that soften when heated, these materials often have molecular structures that are flexible linear or branched molecular structures.

Figure 2:
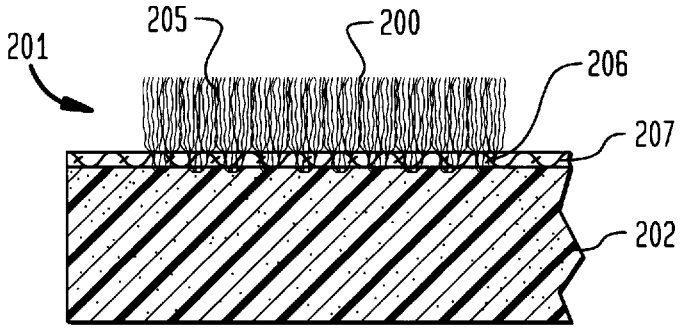
FIG. 2 represents a cross-section of the turf-simulating composite of the present invention.

In the present invention the grass and vegetative layers of natural turf are simulated by a composite mat which is illustrated in FIG. 2. FIG. 2 shows the pile 201 which has tufted strands 205 that simulate grass and a loop portion 206 which is interactively positioned in the lateral-strength fabric 207 that is both encapsulated by, and physically and chemically bonded with, the foamed-plastic element 202.

In natural turf, the root-biomass layer provides a deformable supporting underlayer with structural integrity that holds the turf together and is usually about one-and-one-half inch thick. Grass roots from the root-biomass layer penetrate into the root-soil layer, which is of indefinite thickness. The roots help to link the root-biomass layer and the root-soil layer together. The root-soil layer provides a firm base supporting the flexibility of the top three layers and helps to absorb the energy and disperse forces applied to the surface.

The turf-simulating core of the present invention may be a foamed-plastic element that is formed so that its resiliency gradually increases in a substantially linear manner from the upper surface to the lower surface. In a preferred embodiment, the foamed-plastic composite core is formed of plastic with a density of between six pounds and twelve pounds per cubic foot. The foamed-plastic element of the composite core is integrally foamed to give a material that has great flexibility and a firm but pliable feel. In a multiple-segment embodiment of the invention the lower segments of the foamed-plastic composite core are made from the same plastic but foamed to a lesser extent to yield a material that has lesser flexibility, and greater firmness, but which retains some pliancy.

TABLE 4

| THERMOSETTING POLYMERS | ELASTOMERIC POLYMERS | THERMOPLASTIC POLYMERS |
|---|---|---|
| Alkyds | Acrylate | Acetates |
| Diallyl phthalate | Butyl | Acrylics |
| Epoxies | Chlorosulfonated | Cellulosics |
| Melamines | Polyethylene hypalon | Chlorinated polyethers |
| Phenolics | Fluorocarbons | Fluorocarbons |
| Urethanes - rigid foam | Fluorosilicans | Nylons polyamides |
| Silicones - rigid resins | Polysulfides | Polycarbonates |
| | Polyurethanes | Polyethylenes |
| | Neoprenes | Polypropylenes |
| | Nitriles | Polyimides |
| | Silicones | Polyphenylene oxides |
| | Styrene | Polystyrenes |
| | Butadienes | Polysulphones |
| | | Vinyls |

Figure 3:
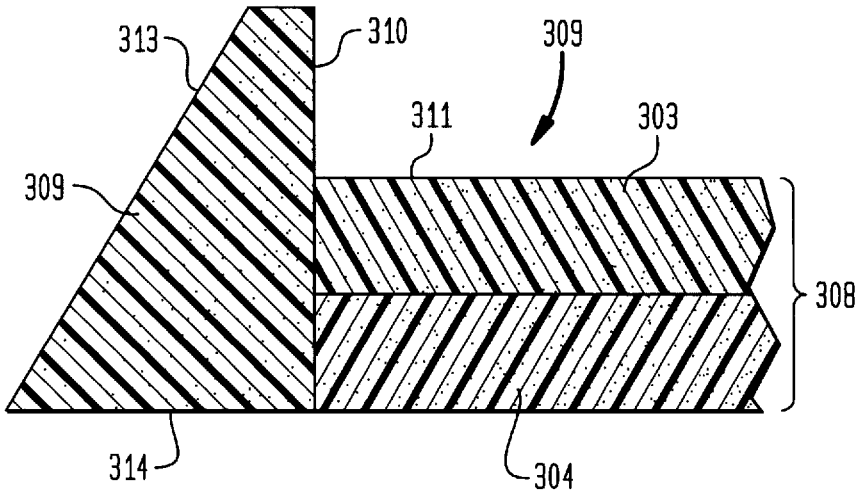
FIG. 3 represents a cross-section through the rim and a portion of the composite core of the integrally rimmed base of the present invention.

FIG. 3 shows the foamed-plastic composite core 308 of the base of the present invention. The foamed-plastic composite core 308 has upper 303 and lower 304 integrally formed plastic foam elements with the upper plastic foam element 303 and the lower plastic foam element 304 both having a density of between eight and twelve pounds per cubic foot. The upper plastic foam element 303 and the lower plastic foam element 304 however are formed so that lower foam element 304 has a greater resiliency than upper foam element 303.

Other embodiments of the foamed-plastic core of the base of the present invention may have a single plastic element of foamed polyethylene or a plurality of integrally formed plastic foam elements with the density of each succeeding lower level being greater that the immediately preceding level above. Generally, the density of the plastic foam elements of such an embodiment increase from the uppermost to the lowermost elements. Generally also, the foamed-plastic elements of the core of the invention will be about two-inches thick in total regardless of whether they comprise a single layer or multiple layers.

The rimmed base of the second component of the present invention is integrally formed around the foamed-plastic composite core. In preferred embodiments of the present invention as shown in FIG. 3, the rim 309 has a generally trapezoid cross-section. A vertical internal surface 310 is positioned so that it, together with the upper surface 311 of the upper plastic element 303 of the foamed-plastic composite core 308, provides a recess 309 that fits the composite mat that simulates the grass and vegetative layers of turf. As shown in FIG. 3, in preferred embodiments of the invention, the outside, or external surface 313 of the rim 309 is angled outwards towards the base 314 so that when the device is in use, a layer of natural soil can be overlaid on the angled external surface 313 to securely locate the entire golf practice tee device. The angled external surface 313 also allows for the natural expansion and contraction of natural turf so that no void is created between the device and the turf.

On natural turf, as a golfer takes a divot and the soil is cut away, the turf has enough pliancy to compress under the sole of a golf club and allow the club head to pass through with little resistance. A preferred embodiment of the artificial turf of the invention disclosed herein has a surface that can accommodate and compress under the sole of a golf club and allow the club head to pass with resistance that is experientially similar to that of play on a natural surface.

Figure 4:
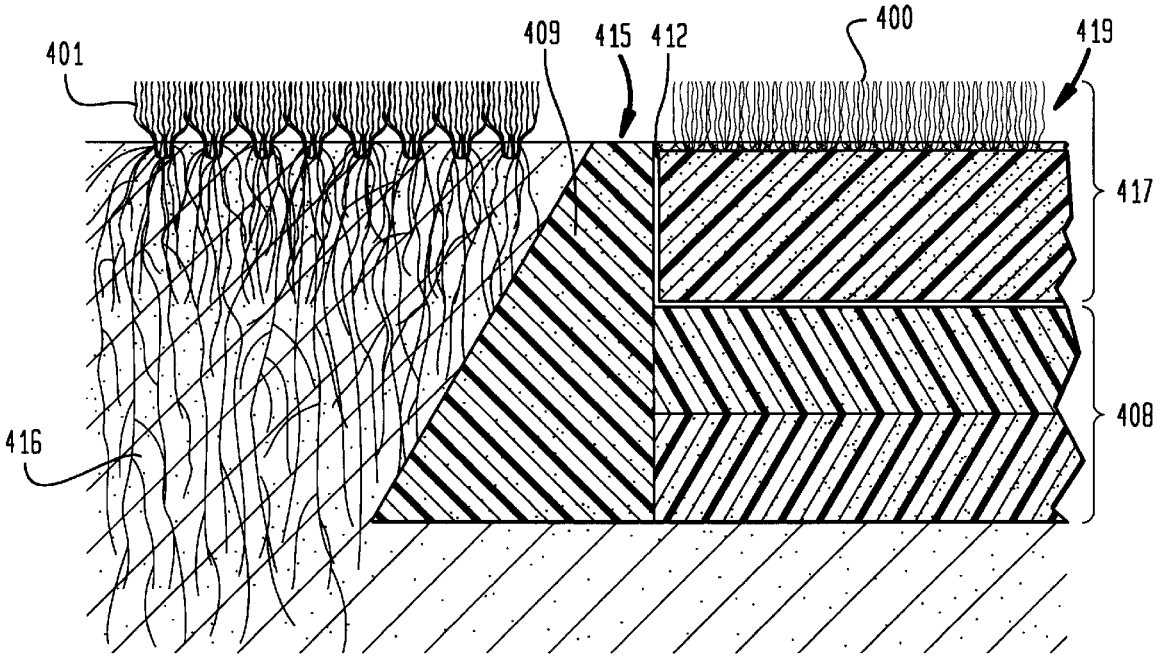
FIG. 4 represents a cross-section through the rim, a portion of the composite core of the integrally rimmed base and the turf-simulating composite of the present invention together with adjacent soil and grass.

Another embodiment of the invention has a striking-surface positioned level with the ground. Such an embodiment is shown in FIG. 4. In this embodiment the base component 415 comprising the rim 409 and the foamed-plastic composite core 408 is installed into the ground 416, so that the surface 400 of the pile 419 of the composite mat 417, when installed in the recess 412, is level with the surface of the natural grass 401. The striking surface 400 of this embodiment of the invention feels and looks like natural turf and provides a simulation of actual playing conditions.

Figure 5:
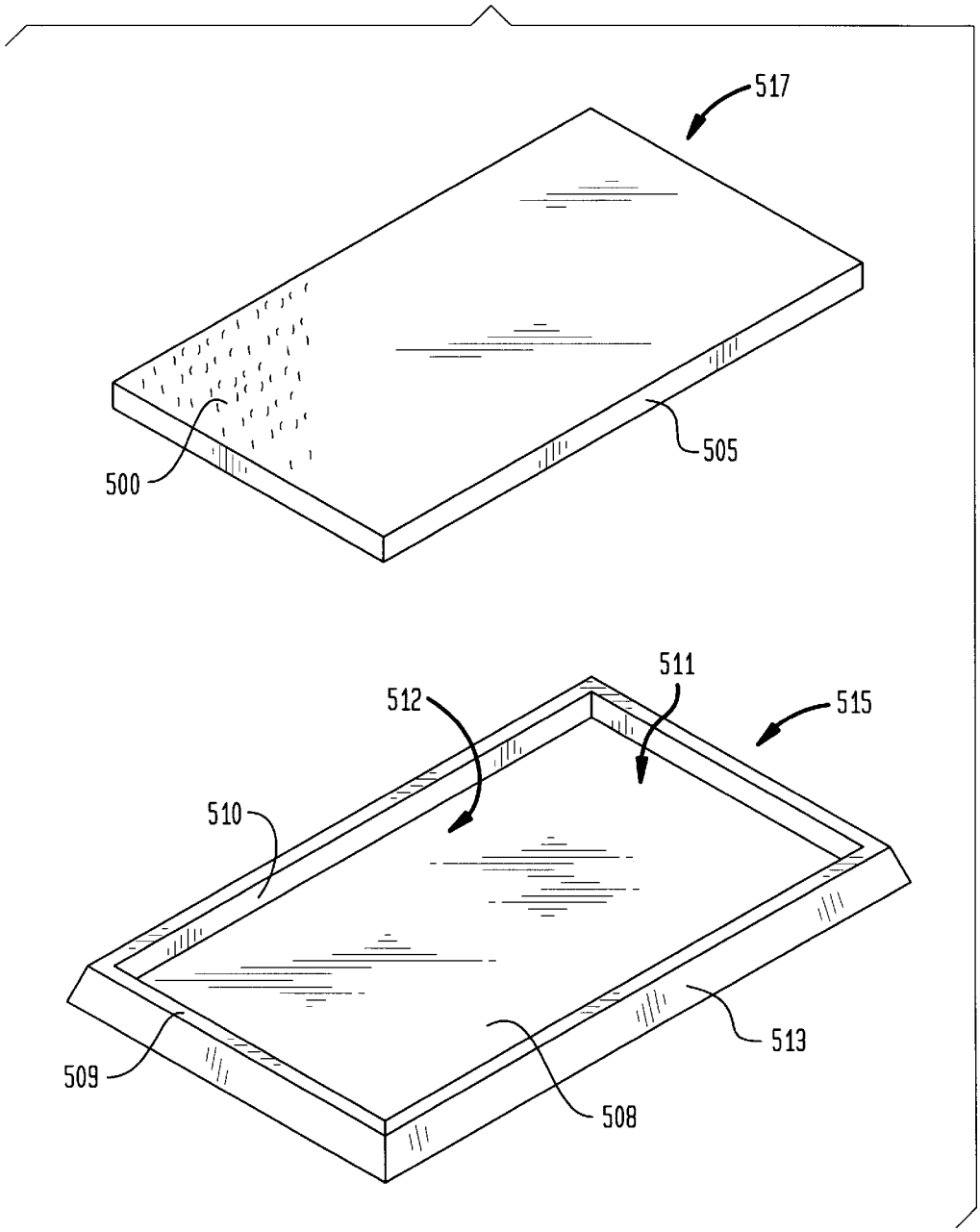
FIG. 5 is an exploded perspective view of an integrally rimmed base and a turf-simulating composite of the present invention.

FIG. 5 shows an isometric view of the two components of the practice tee device. The composite mat 517 and the base component 515 of the present invention are shown. The vertical internal face 510 of the base component 515 is shown in a manner to indicate how it, together with the upper surface 511 of the foamed-plastic composite core 508, forms a recess 512 into which fits composite mat 517. The upper surface of the composite mat 517 is shown as a grass-like surface 500. The composite mat 501 is shown as it would fit into the recess 512 of the base component 515. FIG. 5 also shows the angled edge or external surface 513 of the rim 509 that in use is covered with natural soil overlaid on the angled external surface 513 to securely hold the entire golf practice tee device in place.

Other embodiments of the present invention provide replaceable teeing blocks in addition to hitting surfaces. Replaceable tee blocks allow golfers to use real tees placed in a position and at a height that suits their own individual needs, as would occur in play on a natural surface. Tee block sections provided in certain embodiments of the present invention accommodate the frequent, localized, tee punctures of the surface. These embodiments of the invention allow replacement of portions of the surface which are subject to excessive wear without the need to replace the entire playing surface. Tee blocks of this embodiment of the invention have a form similar to the composite mat of the invention and have a foamed-plastic element integrally formed with the lateral-strength fabric and the pile. However, the foamed-plastic element is formed to be about two inches thick in order to accept the full length of a conventional golf tee.

A base of an embodiment of the invention that is designed to accept tee blocks has a two inch deep recessed area formed and shaped into it to accommodate and locate the tee block.

Figure 6:
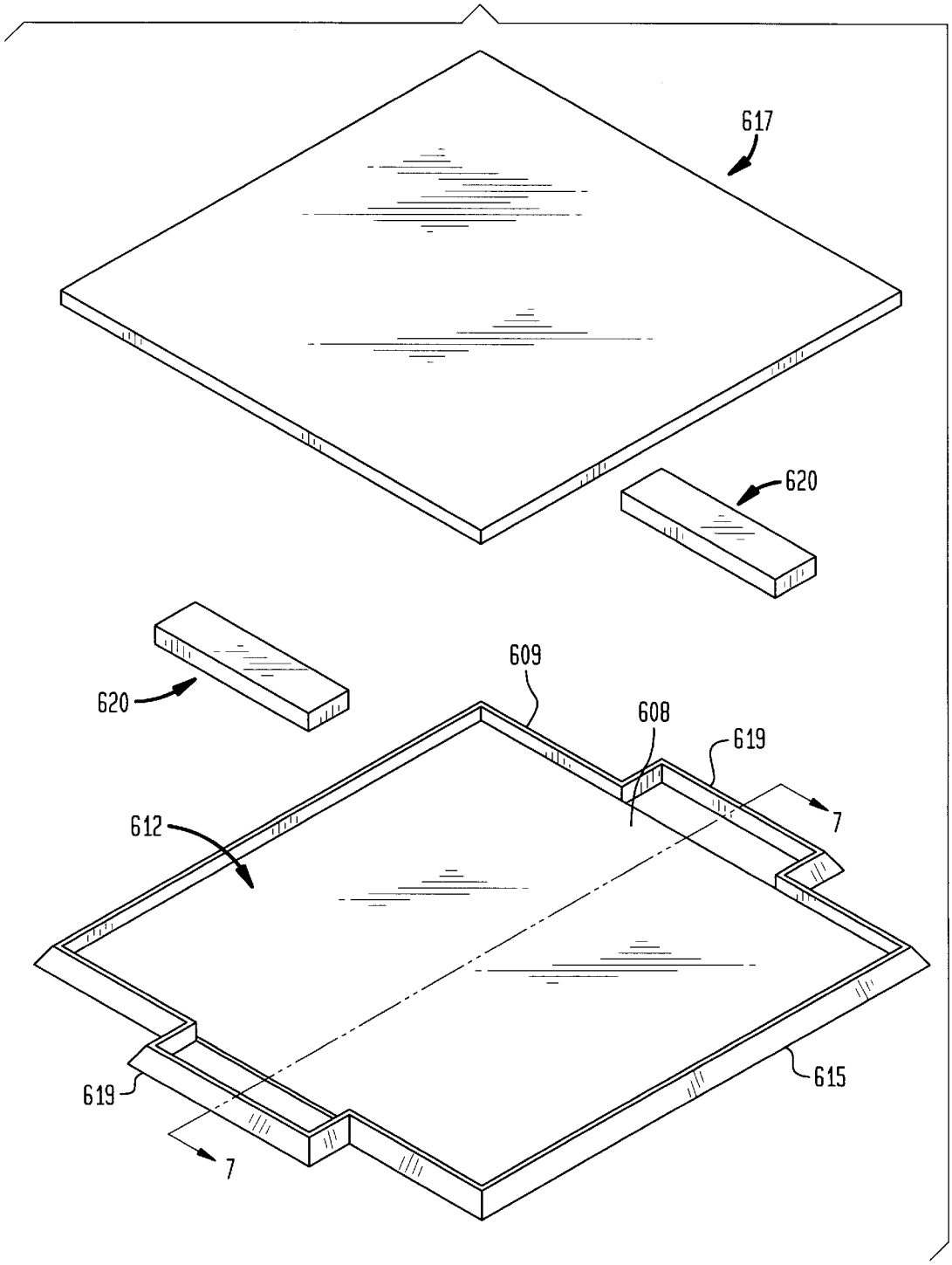
FIG. 6 is an exploded perspective view of an integrally rimmed base and a turf-simulating composite of the present invention together with laterally positioned Tee blocks.

Yet another embodiment of the present invention, suitable for use on a driving range, has tee blocks positioned at the sides of the golf mat. FIG. 6 shows an embodiment of the present invention in which the base component 615 is formed so that rim 609 has rectangular extensions 619 positioned on opposite sides of base component 615 formed to provide locations for replaceable teeing blocks 620. In this embodiment, the foamed-plastic composite core 608 does not extend into the rectangular extensions 619. The rectangular composite mat 617 of this embodiment is formed to fit into the recess 612 but does not extend into the rectangular extensions 619. Thicker, rectangular composite mat teeing blocks 620 are shown that fit within the rectangular extensions 619 so as to be level with the surface of composite mat 617. For simplicity of diagrammatic representation, the pile striking surface, the lateral-strength fabric and the foam element components of the composite mat 617 and the teeing block portions 620 are not explicitly illustrated in FIG. 6. Line 7—7 indicates the location and direction of the cross-sectional view shown in FIG. 7.

Figure 7:
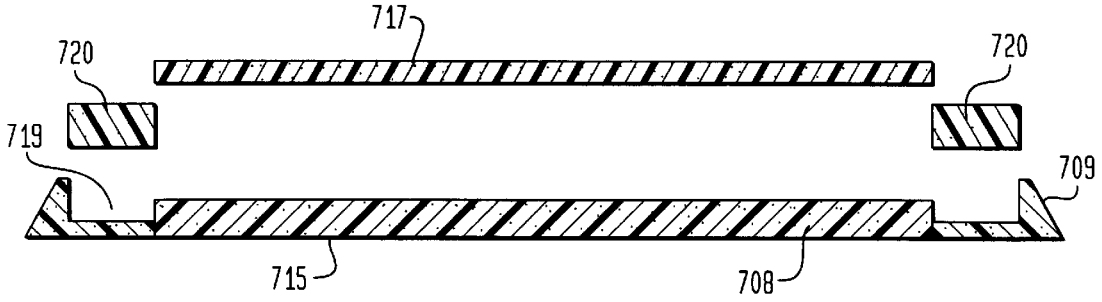
FIG. 7 represents is an exploded cross-section view through line 7 shown in FIG. 6.

FIG. 7 shows an exploded cross-sectional representation along line 7—7 of the embodiment of the present invention illustrated in FIG. 6. This cross-sectional representation shows how rim 709 of base component 715 has rectangular extensions 719 positioned on opposite sides of base component 715. Foamed-plastic composite core 708 is shown not to extend into the rectangular extensions 719. Rectangular composite mat 717 is shown not to extend into the rectangular extensions 719. Thicker, rectangular composite mat "teeing block" portions 720 are shown that fit within the rectangular extensions 719 so as to provide a surface level with that of composite mat 717.

Figure 8A:
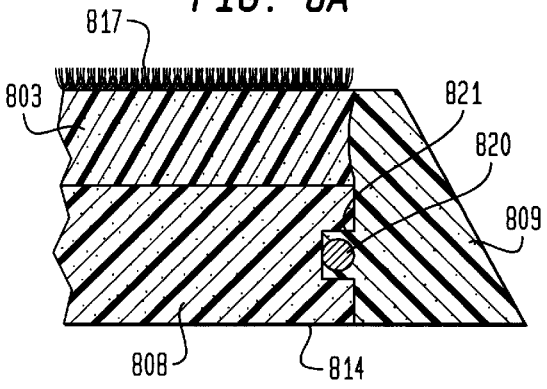
FIG. 8*a* shows a cross-sectional views through the rim of an embodiment of the invention that has a reinforcing rod therein.

In some embodiments of the invention, the rimmed base of the second component is integrally formed around a foamed-plastic composite core. Other embodiments are formed without such a rimmed base. To achieve improved integrity of the base component, the rim may be reinforced with a reinforcing rod and the edge of the foamed-plastic core may be shaped to interdigitate with the rim. FIG. 8*a* shows a cross-section of a portion of the base 814 and composite mat 817 of an embodiment of the present invention. Also illustrated in FIG. 8*a* is a cross-section of an embodiment showing of portions of core 808, the shaped edge 821 together with the reinforcing rod 822 and adjacent rim region 809. Also shown is the pile layer 801 and the foam layer 803 of the composite mat 817.

Figure 8B:
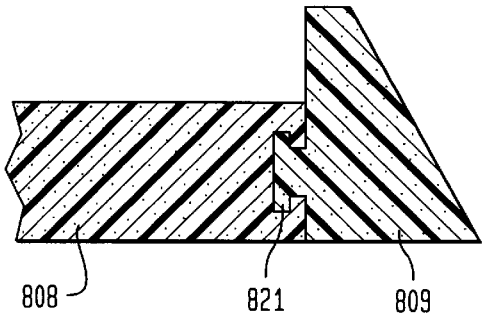
FIGS. 8*b*, 8*c*, and 8*d* show portions of the composite core and of the integrally rimmed base of embodiments of the present invention in which the edges of the plastic composite core are shaped so that the rim and the core interlock.
Figure 8C:
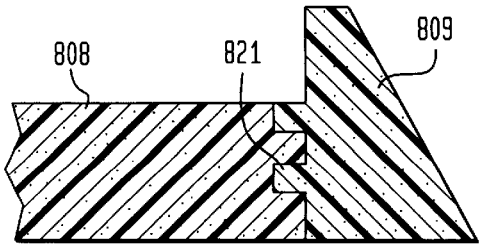
Figure 8D:
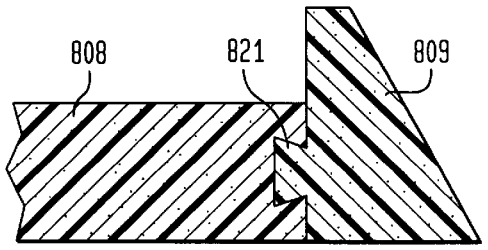

The edges of the foamed-plastic core may be variously shaped to provide interlocking surfaces, before formation of the rim around the core. FIGS. 8*a*, 8*b* and 8*c* show cross-sections of three further embodiments of portions of core 808 of the present invention showing three different shaped edges 821 together with adjacent rim regions 809. Other shapes, such as oval or elliptical, that achieve similar interlocking effects will be obvious to those of skill in the art.

Figure 9:
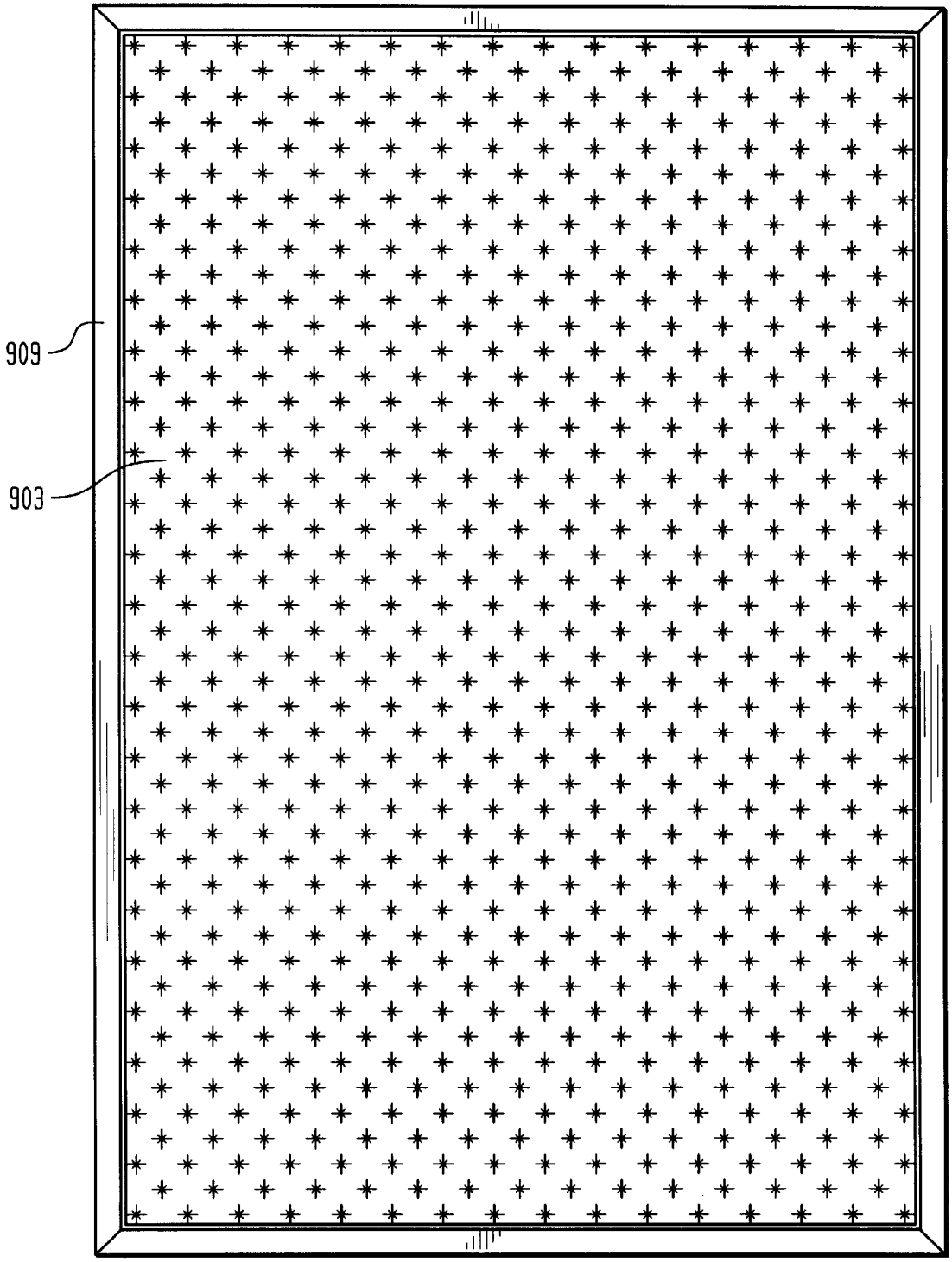
FIG. 9 is a plan view of an integrally rimmed base and a turf-simulating composite of the present invention together with inserted Tee blocks.

Other embodiments of the present invention are rectangular and may be eight by twelve feet in size or of any other size, shape or dimension that suits the needs of a golf practice range. Certain of such embodiments, as shown in FIG. 9, have a rim 909 surrounding the hitting surface 903.

Figure 10A:
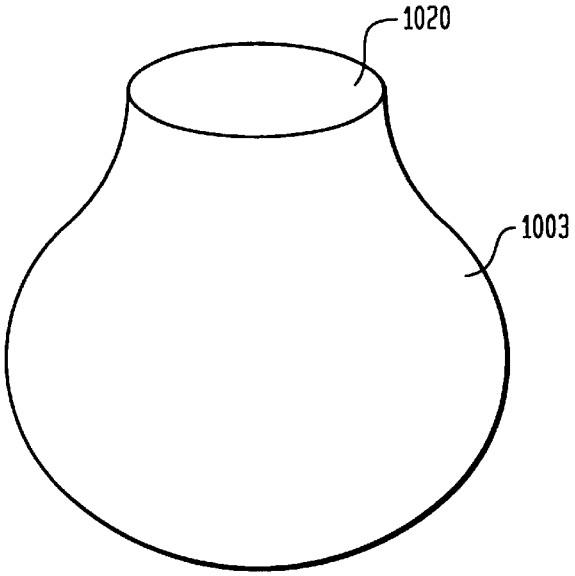
FIGS. 10*a*, 10*b* and 10*c*, are plan views of three fancifully shaped embodiments of the present invention with Tee blocks.
Figure 10C:
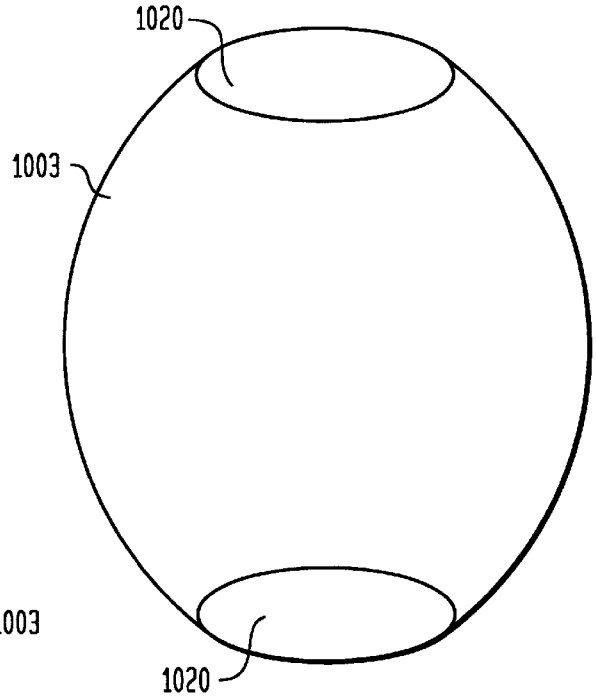
Figure 10B:
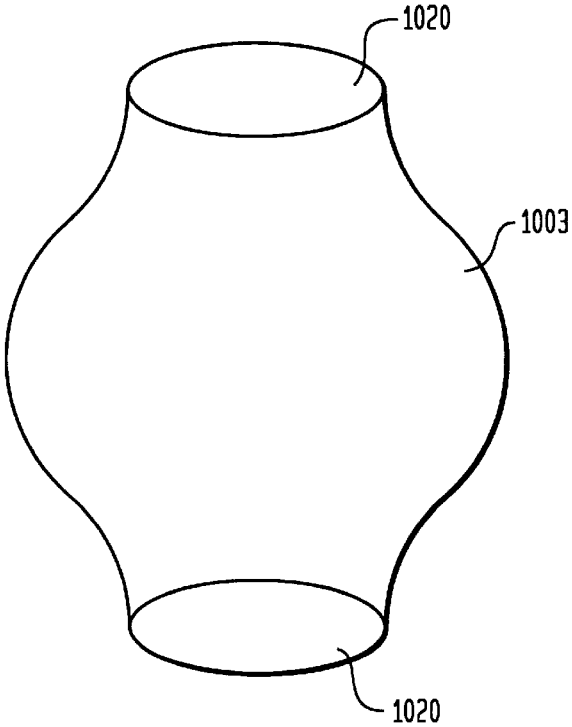

Others of such embodiments are shown in FIG. 10, and may be of any fanciful shape suitable for use as a golf teeing surface. FIGS. 10*a*, and 10*b* show embodiments with oval teeing blocks 1020 and differently shaped hitting surfaces 1003. FIG. 10*c* shows an embodiment with "new moon" shaped teeing blocks 1020 and a circular hitting surface 1003.

The present invention addresses problems not successfully addressed by the prior art. An artificial golf mat should do more than merely have a grass-like appearance. The present invention effectively simulates both the physical energy absorbing properties of natural turf and has similar force absorbing and feedback qualities and simulates the appearance of natural turf. In the present invention a composite mat simulates the properties of the upper layers of natural turf and a base layer simulates the supportive properties of the deeper layers of natural turf.

To further illustrate the invention, the following examples are provided. However, it is to be understood that these examples are for illustrative purposes only and that many variations and combinations of elements may be used as will be clear to those of skill in the art.

Exemplary Turf Simulating Surfaces

EXAMPLE 1

An exemplary embodiment of the turf-simulating composite of the present invention has an artificial surface of one-half-inch-long pile formed of a texturized nylon yarn that is tufted into a two-ply lateral-strength fabric backing. One ply of the lateral-strength fabric used in this example of the invention is a polypropylene cloth-type fabric. The other ply of the lateral-strength fabric is a polypropylene pick-weave fabric of 18 strands per inch which also has some spun bonding. The polypropylene pick-weave fabric gives a strong tuft bind and the spun bonding reduces the brittle-plastic feel of the fabric. The amount of spun bonding is selected to modify the overall feel of the final surface and to control the bleed-through of the foam and promote the encapsulation of the nylon yarn.

The integral foam layer of the turf-simulating composite of the exemplary embodiment is formed of MC-10-5964 two-part, microcellular, flexible, polyurethane foam, obtainable from Flexible Products Company, Marietta, Ga. In this embodiment of the invention, Component A and Component B of the polyurethane precursor components are mixed in a ratio of 51 parts to 100 parts respectively by weight, and reacted in a mold to yield a foam density of about 10 pounds per cubic foot. The integral foam layer of this exemplary embodiment is one inch thick and self-skinned on the sides and the bottom of the finished mat. The upper surface of the integral foam layer is formed by the penetration of the two-ply lateral-strength fabric by the polyurethane precursor components as formation of the turf-simulating composite occurs by polymerization.

The base of the turf-simulating composite of the exemplary embodiment is an integrally-rimmed base formed of two-inch-thick medium density foamed polyethylene of about 9 pounds per cubic foot. An example of such foamed polyethylene known as "Polyplank® White 9 PCF" is manufactured by Astro-Valcour, Inc., Glens Falls, N.Y.

EXAMPLE 2

A turf-simulating composite of the present invention as described in Example 1, but formed by reacting a mixture of Component A and Component B of the polyurethane precursor components in a ratio of 54 parts to 100 parts respectively by weight. This exemplary embodiment of the invention has a increased resiliency compared to that disclosed in Example 1.

EXAMPLE 3

A turf-simulating composite of the present invention as described in Example 1, formed with a lateral-strength fabric that has the form of a commercially available cord-type knitted fabric. This exemplary embodiment of the invention provides a grass-like surface with increased responsiveness compared to that disclosed in Example 1.

EXAMPLE 4

A turf-simulating composite of the present invention as described in Example 1, formed with a lateral-strength fabric that has the form of a commercially available polyester loop-pile fabric that is mechanically linked by a knotting process and bonded with a one-eighth inch foam layer. This exemplary embodiment of the invention provides a grass-like surface whose strands are differently and more securely located in the mat and with greater lateral strength compared to that disclosed in Example 1.

The present invention is illustrated by reference to the preceding disclosure. One skilled in the art will readily appreciate that the present invention is well adapted to carry out the objects and obtain the ends and advantages mentioned, as well as those inherent therein. The components, methods, procedures and techniques described herein are presently representative of the preferred embodiments, are intended to be exemplary, and are not intended as limitations on the scope of the present invention. Changes therein and other uses will occur to those skilled in the art which are encompassed within the spirit of the invention and are defined by the scope of the appended claims.

Having described the invention, what it is desired to claim by Letters Patent is:

1. A golf practice tee device that simulates the four-layer properties of natural turf, said device comprising a turf-simulating composite and an integrally rimmed base;

said turf-simulating composite comprising a pile section, a lateral-strength fabric and a plastic foam element;

said pile section comprising a filament portion and a loop portion, said loop portion interactively associated with said lateral-strength fabric, and said plastic foam element formed to encapsulate and bond to said lateral-strength fabric and to said loop portion of said pile section; and said integrally rimmed base comprising a foamed-plastic core or a composite plastic core and a foamed-plastic rim.

2. The golf practice tee device of claim 1, wherein:

said pile section is made of a material selected from the group consisting of polyester, polyacrylic, polyolefin, polypropylene, high-strength polyethylene, polyamide, polyimide, aromatic polyamide, aromatic polyester and aromatic polyimide.

3. The golf practice tee device of claim 2, wherein:

said filament portion of said pile section has a length of about one half inch; and said loop portion of said pile section is interactively associated with said lateral-strength fabric by means selected from the group consisting of looping, tufting, weaving, and knitting.

4. The golf practice tee device of claim 3, wherein said lateral-strength fabric is a two-ply fabric having a plurality of plies, wherein:

a first ply comprises a polypropylene cloth, and a second ply comprises a spun bonded pick-weave polypropylene cloth.

5. The golf practice tee device of claim 1, wherein:

said loop portion of said pile section interactively associated with said lateral-strength fabric is from about one sixteenth inch to one quarter inch across.

6. The golf practice tee device of claim 1, wherein:

said plastic foam element is a polyurethane foam with an average cell size of about 0.08 mm and a thickness of about one inch.

7. The golf practice tee device of claim 1, wherein:

said integrally rimmed base comprises:

a foamed-plastic core comprising a single element of foamed polyethylene about two inches thick with a uniform density of about nine pounds per cubic foot;

said foamed-plastic rim is foamed polyurethane with a vertical internal surface and an angled external surface tapering outwardly toward the base of said foamed-plastic rim at an angle in the range from 30° to 50° from the vertical; and said vertical internal surface is adapted, together with an upper surface of said foamed-plastic core, to form a recess in which said turf-simulating composite may be positioned; and said foamed-plastic rim is adapted so that natural soil may be overlaid on said angled external surface and said golf practice tee device may be thereby held securely in place during use.

8. The golf practice tee device of claim 1, wherein:

said integrally rimmed base comprises:

a composite plastic core comprising at least one inch thick;

said foamed-plastic rim is foamed polyurethane with a vertical internal surface and an angled external surface tapering outwardly toward the base of said foamed-plastic rim at an angle in the range from 30° to 50° from the vertical; and said vertical internal surface is adapted, together with an upper surface of said foamed-plastic core, to form a recess in which said turf-simulating composite may be positioned; and said foamed-plastic rim is adapted so that natural soil may be overlaid on said angled external surface and said golf practice tee device may be thereby held securely in place during use.

9. A turf-simulating surface that simulates the properties of natural turf, said surface comprising a surface composite and a composite base, wherein:

said surface composite comprises a pile section, a lateral-strength fabric and a plastic foam element;

said pile section comprises a filament portion and a loop portion interactively associated with said lateral-strength fabric, and said plastic foam element encapsulates and bonds to said lateral-strength fabric and to said loop portion of said pile section; and said composite base comprises a foamed-plastic composite.

10. The turf-simulating surface of claim 9 wherein:

said plastic foam element comprises polyurethane and is about one inch thick, and said foamed-plastic composite base comprises polyethylene and is about two inches thick.

11. The turf-simulating surface of claim 9, wherein:

said foamed-plastic composite base has recesses therein to permit placement of tee-blocks; and additionally comprising:

replaceable tee-blocks set into said recesses and flush with the surface of said surface composite, wherein said replaceable tee-blocks comprise a pile layer, a lateral-strength fabric layer and a plastic foam layer about two inches thick;

said pile layer having a loop portion interactively positioned in said lateral-strength fabric layer, and said plastic foam layer being formed to encapsulate and physically bond to said lateral-strength fabric layer and to said loop portion of said pile layer.

12. The turf simulating surface of claim 9, wherein:

said pile section is made of a material selected from the group consisting of polyester, polyacrylic, polyolefin, polypropylene, high-strength polyethylene, polyamide, polyimide, aromatic polyamide, aromatic polyester and aromatic polyimide.

13. The turf simulating surface of claim 12, wherein:

said filament portion has a length of about one half inch;

said loop portion is interactively associated with said lateral-strength fabric by means selected from the group consisting of looping, tufting, weaving, and knitting; and said lateral-strength fabric comprises a fabric with from 13 to 24 strands-per-inch.

14. The turf simulating surface of claim 13, wherein said lateral-strength fabric is a double lateral-strength fabric comprising a first backing fabric and a second backing fabric wherein:

said first backing fabric comprises polypropylene type cloth, and said second backing fabric comprises spun bonded pick-weave polypropylene.

15. The turf simulating surface of claim 13, wherein said lateral-strength fabric comprises a fabric of about 18 strands-per-inch.

16. The turf simulating surface of claim 9, wherein:

said loop portion interactively positioned in said lateral-strength fabric is from one sixteenth inch to one quarter inch across.

17. The turf simulating surface of claim 9, wherein:

said plastic foam layer element is a composite high performance foam material with an average cell size of about 0.08 mm and a thickness of at least one inch.

* * * * *